US006338475B1

(12) United States Patent
Ping

(10) Patent No.: US 6,338,475 B1
(45) Date of Patent: Jan. 15, 2002

(54) BAR CLAMP

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 09/781,137

(22) Filed: Feb. 12, 2001

(30) Foreign Application Priority Data

Aug. 21, 2000 (CN) ..... 00218939 U

(51) Int. Cl.[7] ..... B25B 1/60
(52) U.S. Cl. ..... 269/6; 269/214
(58) Field of Search ..... 269/6, 212–215, 269/216, 143, 249; 254/208–111, 68–72

(56) References Cited

U.S. PATENT DOCUMENTS

| | | | | |
|---|---|---|---|---|
| 2,236,913 A | | 4/1941 | Merrill | |
| 3,096,975 A | | 7/1963 | Irwin | |
| 3,151,897 A | | 10/1964 | Wagner | |
| 4,088,313 A | | 5/1978 | Pearson | |
| 4,132,397 A | | 1/1979 | Ward | |
| 4,220,322 A | | 9/1980 | Hobday | |
| 4,378,937 A | | 4/1983 | Dearman | |
| 4,563,921 A | | 1/1986 | Wallace | |
| D286,369 S | | 10/1986 | Hahn | |
| 4,627,420 A | | 12/1986 | Katz | |
| 4,874,155 A | * | 10/1989 | Goul | 269/6 |
| 4,893,801 A | | 1/1990 | Flinn | |
| 4,926,722 A | | 5/1990 | Sorensen | |
| 5,002,137 A | | 3/1991 | Sorensen | |
| 5,005,449 A | | 4/1991 | Sorensen | |
| D320,919 S | | 10/1991 | Sorensen | |
| 5,094,131 A | | 3/1992 | Sorensen | |
| D328,846 S | | 8/1992 | Sorensen | |
| 5,154,398 A | | 10/1992 | Mayfield | |
| 5,174,553 A | * | 12/1992 | Challis | 269/6 |
| 5,222,420 A | | 6/1993 | Sorensen | |
| 5,282,303 A | | 2/1994 | Schriever | |
| D355,104 S | | 2/1995 | Sorensen | |
| D366,820 S | | 2/1996 | Wooster | |
| 5,499,800 A | * | 3/1996 | Albin | 269/6 |
| 5,826,310 A | | 10/1998 | Hobday | |
| 5,853,168 A | * | 12/1998 | Drake | 269/6 |
| D417,377 S | | 12/1999 | Blank | |
| 6,113,085 A | * | 9/2000 | Lindenthal | 269/6 |

FOREIGN PATENT DOCUMENTS

| | | |
|---|---|---|
| GB | 1 408 886 | 10/1975 |
| GB | 1 472 278 | 5/1977 |
| GB | 1 516 748 | 7/1978 |
| GB | 1 544 156 | 4/1979 |
| GB | 1 555 455 | 11/1979 |
| GB | 2178 689 | 2/1987 |
| GB | 2204 264 | 11/1988 |

OTHER PUBLICATIONS

Rhombus Tool Flyer—date unknown.

* cited by examiner

*Primary Examiner*—Joseph J. Hail, III
*Assistant Examiner*—Daniel Shanley
(74) *Attorney, Agent, or Firm*—Joseph J. Previto

(57) ABSTRACT

A bar clamp having a first jaw assembly, a second jaw assembly and a bar. The first and second jaw assemblies are mounted on the bar which is movable relative to the second jaw assembly. A trigger is operatively associated with the bar and is adapted to be activated to move the bar and the first jaw assembly relative to the second aw assembly in one direction. A release mechanism on the second jaw assembly is operatively associated with the bar and is adapted to be activated in order to permit the bar and the first jaw assembly to move relative to the second jaw assembly in the opposite direction.

21 Claims, 6 Drawing Sheets

BAR CLAMP

BACKGROUND

The present invention relates to a bar clamp and more particularly to an improved ratchet type bar clamp in which the jaws may be moved toward each other step-by-step and the jaws may be moved apart when desired.

Ratchet type bar clamps have been in use for a number of years. They usually comprise a jaw mounted on a moveable bar and another jaw mounted on a stationary handle assembly. A trigger is provided in the handle assembly which when pressed will move the jaws closer together in a series of steps. When is desired to move the jaws apart, a release button is activated to move the jaws apart. Existing ratchet type bar clamps are complicated and expensive to manufacture and assemble and many are not easily capable of being used by one hand.

Objects

The present invention overcomes these drawbacks and has for one of its objects the provision of an improved bar clamp which is simple to use.

Another object of the present invention is the provision of an improved bar clamp in which the jaws can be advanced toward each other with one hand.

Another object of the present invention is the provision of an improved bar clamp in which the jaws can be released to moved away from each other by the same hand.

Another object of the present invention is the provision of an improved bar clamp in which the jaws can be easily placed in position to spread apart an article as well as to tighten on an item Another object of the present invention is the provision of an improved bar clamp which is simple and inexpensive to manufacture.

Other and further objects of the invention will be obvious upon an understanding of the illustrative embodiment about to be described, or will be indicated in the appended claims and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawings forming a part of the specification, wherein.

Drawings

DESCRIPTION

Figure 8:
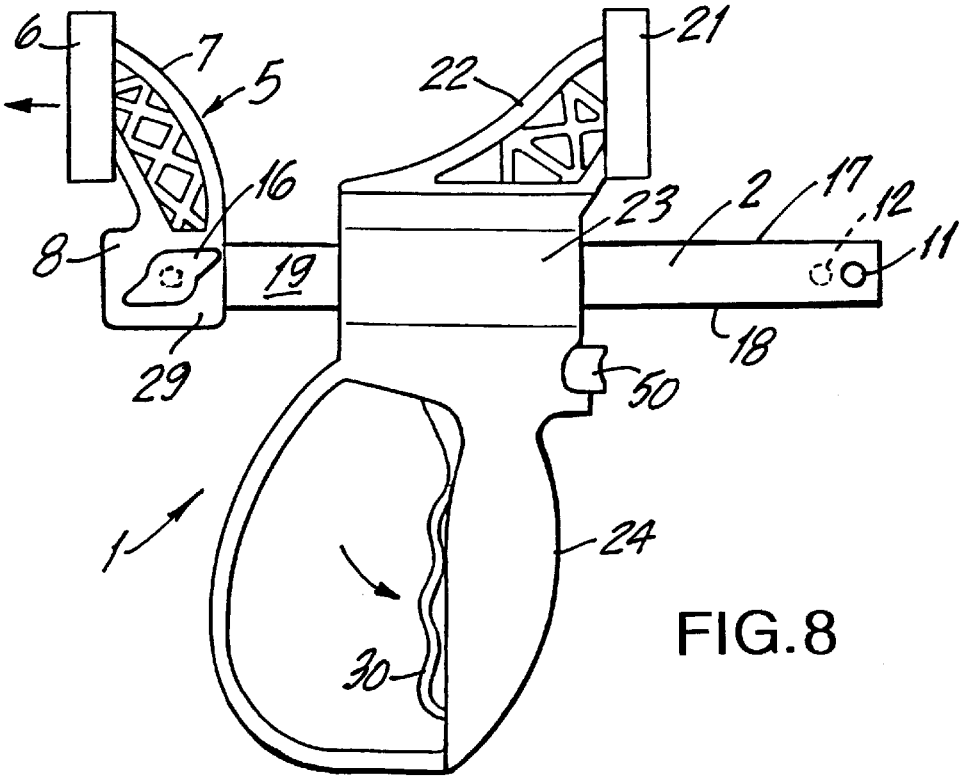
FIG. 8 is a plan view similar to FIG. 7 showing the jaws being moved apart from each other in an item spreading position
Figure 9:
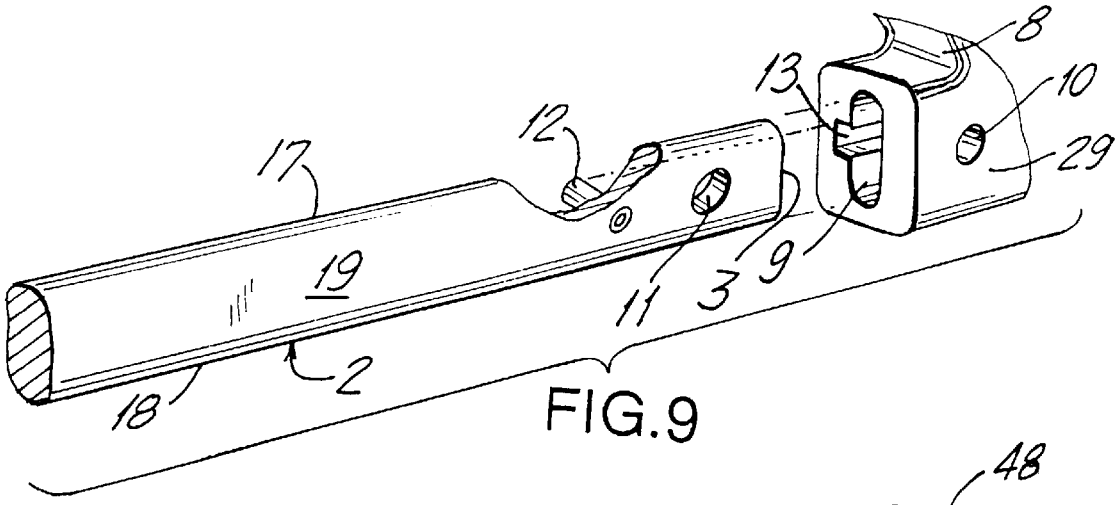
FIG. 9 is in perspective detail view showing the manner of positioning the bar into one of the jaw bases.
Figure 10:
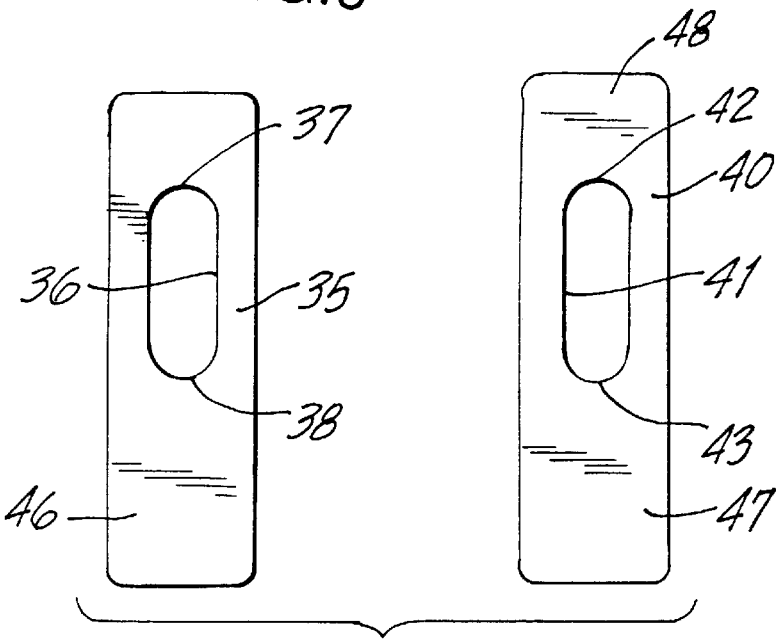
FIG. 10 is a plan view of two control plates used with the present invention.
Figure 11:
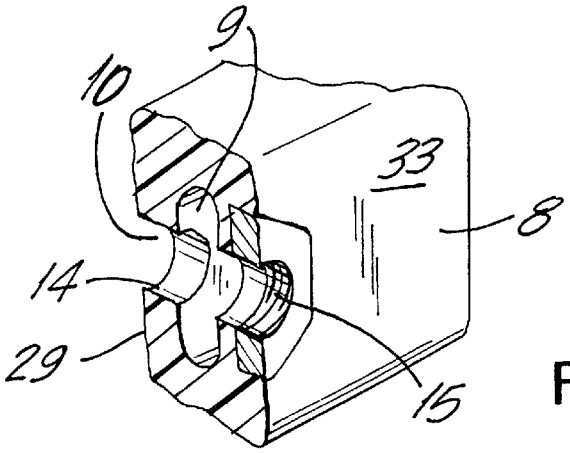
FIG. 11 is a sectional view taken along line 11—11 of FIG. 7.

Referring to the drawings, the bar clamp 1 of the present invention comprises a straight bar 2 having a front end 3, a rear end 4, a top edge 17 a bottom edge 18 and side walls 19. The front and rear ends 3–4 each have an opening 11 and a guide pin 12 extending therefrom. Removably mounted on front end 3 is a first jaw assembly 5 which comprises a gripping face 6, a body 7, and depending a base 8. The base 8 has an opening 9 (FIG. 8) into which the front or rear end 3–4 end 3 of the bar 2 may be inserted and a side hole 10 extending from one face of base 8 through to the other face 33. The guide pin 12 is adapted to slide in a groove 13 in opening 9 in the base 8 to guide the bar into the opening 9 in the base 8. The side hole 10 has inner end 14 which is plain and smooth and an outer end 15 which is threaded. The jaw assembly 5 is held in place by a threaded wing nut 16 inserted in the inner end 14 of the opening 10 in base 8 of the jaw assembly 5 and through the opening 11 in the bar 2 and tightened into the threaded outer end 15 of side hole 10 in the base 8.

A second jaw assembly 20 comprises a gripping face 21, a body portion 22 and a base portion 23 depending therefrom. The base portion 23 of the second jaw assembly 20 has a handle portion 24 extending downwardly therefrom. The base portion 23 is substantially hollow and has front and rear walls 25–26 with openings 27–28 therein which are in alignment with each other and through which the bar 2 extends. The handle portion 24 has a trigger 30 which is pivotally mounted therein at 31 and which has its upper active head 32 extending into the base portion 23 through opening 33.

Within the hollow base portion 23 the bar 2 has a control advancing plate 35 and a control release plate 40 mounted thereon. The advancing plate 35 has an opening 36 therein through which the bar 2 extends and a lower portion 46. The opening 36 has upper and lower edges 37 and 38. A spring 39 is interposed between the rear wall 26 of the base portion 23 and the advancing plate 35 in order to hold the advancing plate 35 in a position substantially perpendicular to the bar 2. In this position the upper and lower edges 37–38 of the advance plate 35 do not engage the upper and lower edges 17–18 of the bar and do not affect the bar 2.

Figure 1:
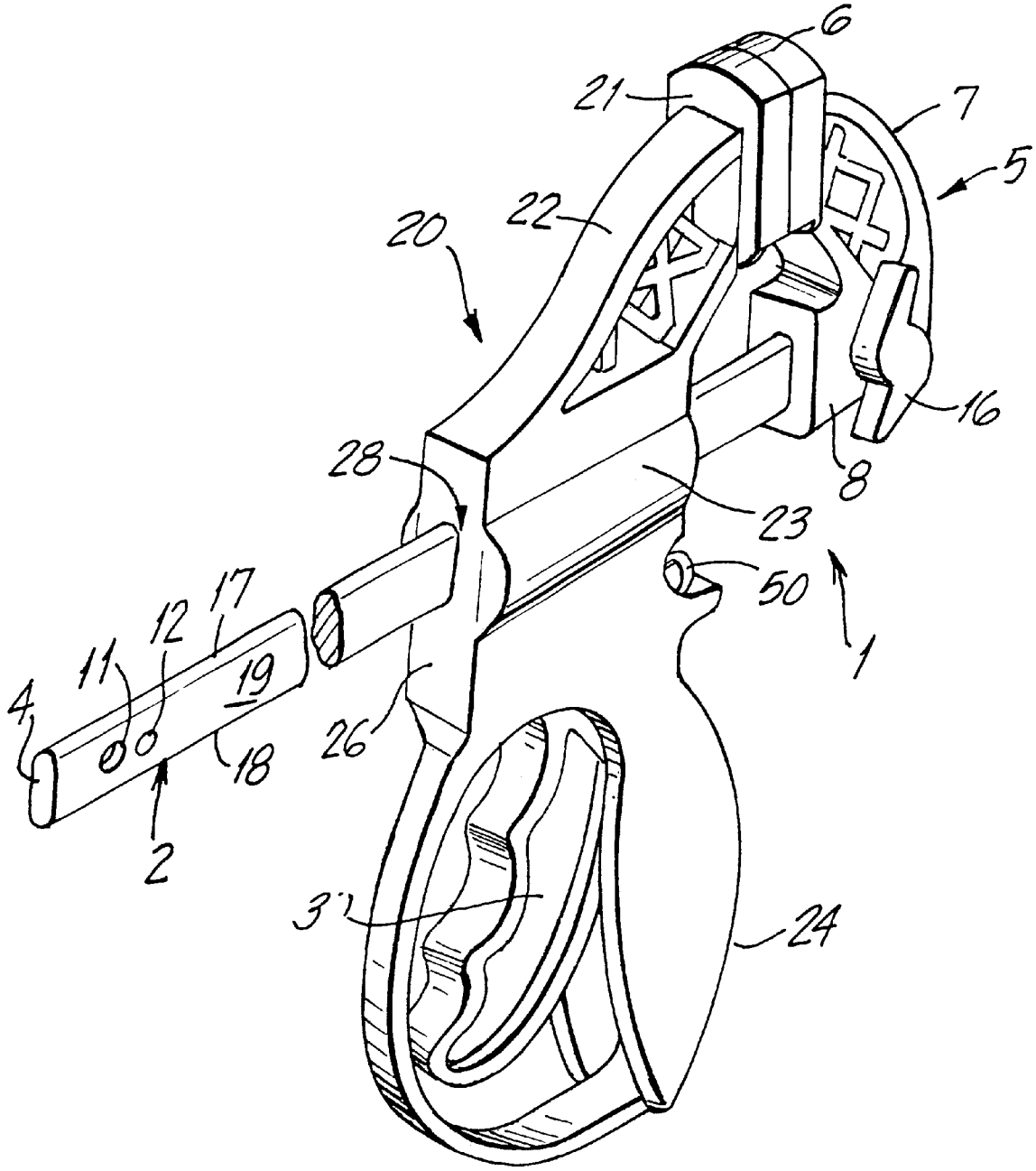
FIG. 1 is a perspective view of a bar clamp made in accordance with the present invention.
Figure 2:
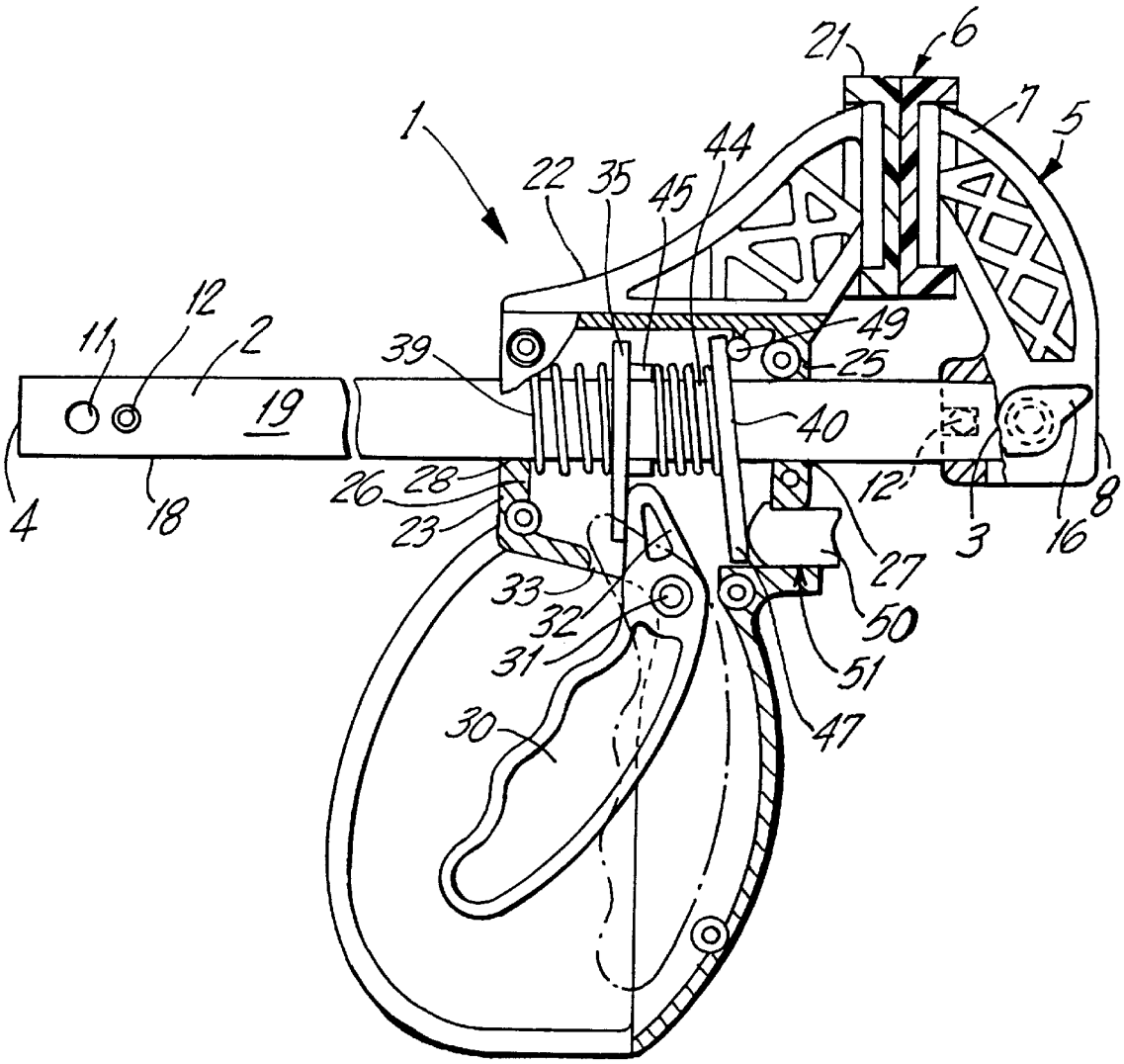
FIG. 2 is a sectional view of the bar clamp taken along line 2—2 of FIG. 1.
Figure 3:
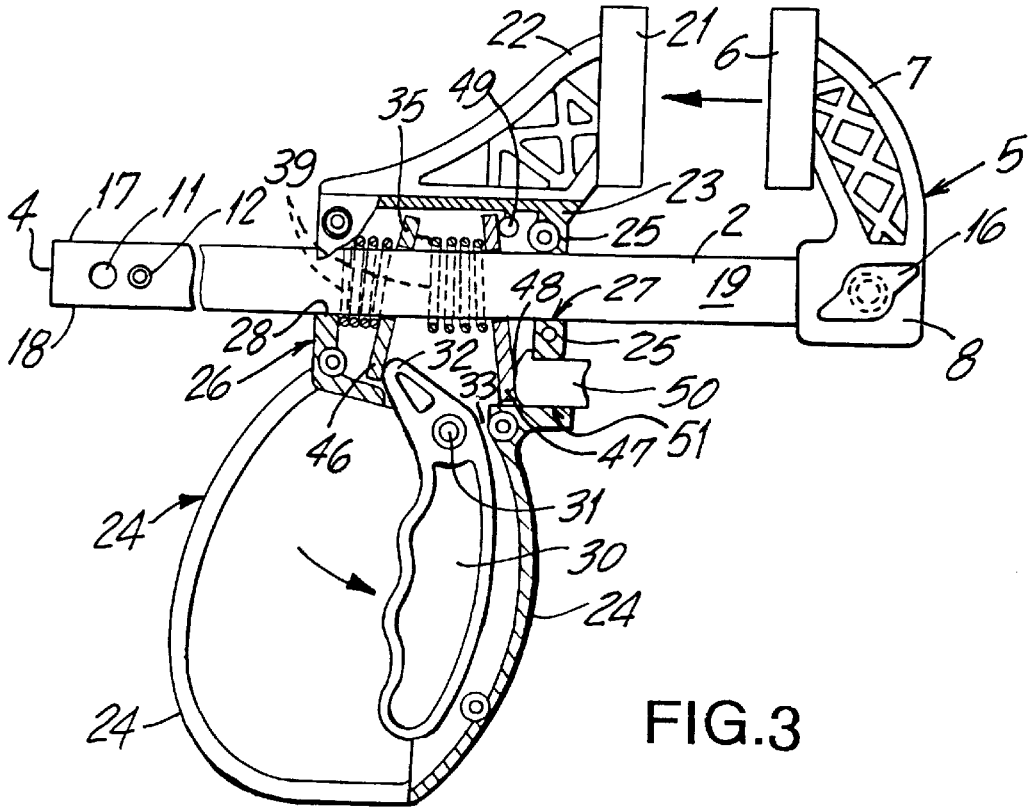
FIG. 3 is a sectional view similar to FIG. 2 showing the position of the parts when the jaws are to be moved closer together.

Between the advance plate 35 and the front wall 25 of the base 23, the base 2 has the release plate 40 mounted thereon which also has an opening 41 therein through which the bar 2 extends. The opening 41 has upper and lower edges 42–43 and a lower portion 47. A spring 44 is mounted between the release plate 40 and a collar 45 adjacent the advancing plate 35. The release plate 40 is normally in a substantially angled position (FIG. 2) with its upper portion 48 resting on pivot stop 49 and the lower portion 47 resting on release button 50 on it upper edge 42 bearing against the upper edge 17 of the bar 2. In this position, the bar 2 cannot move rearwardly because it is locked in place by the upper edge 42 of the opening 4 in the release plate 40 bearing against upper edge 17. A release button 50 extends through an opening 51 in the lower part of the front wall 27 base 23 and bears against the lower portion 47 of the release plate 40.

Figure 4:
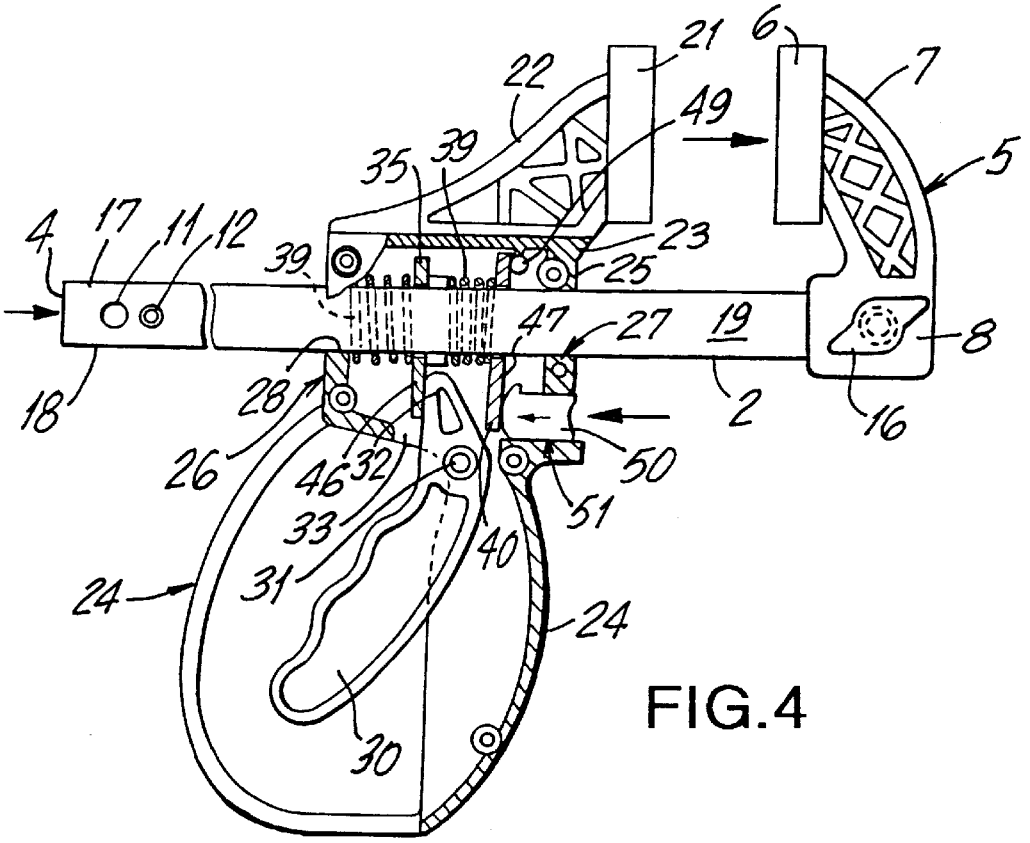
FIG. 4 is a sectional view similar to FIG. 2 showing the position of the parts when the jaws are to be moved apart.
Figure 5:
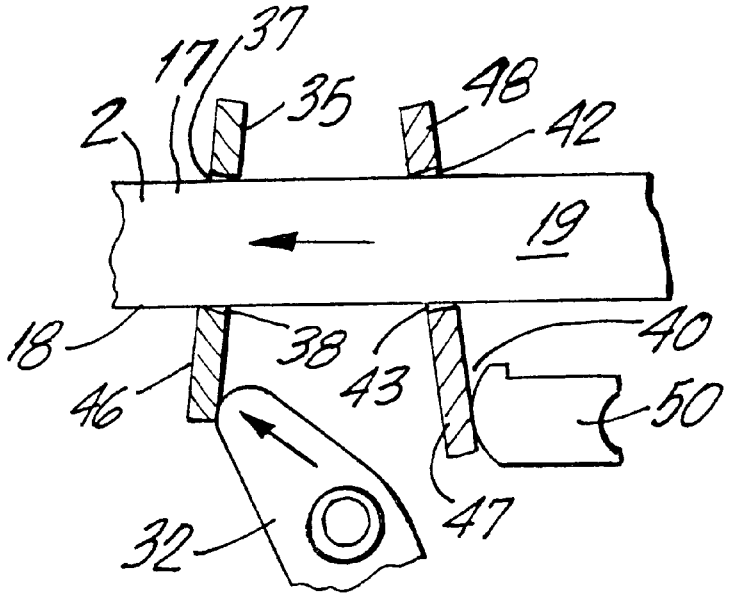
FIG. 5 is a detail showing the position of some of the parts when the jaws are to be moved toward each other.
Figure 6:
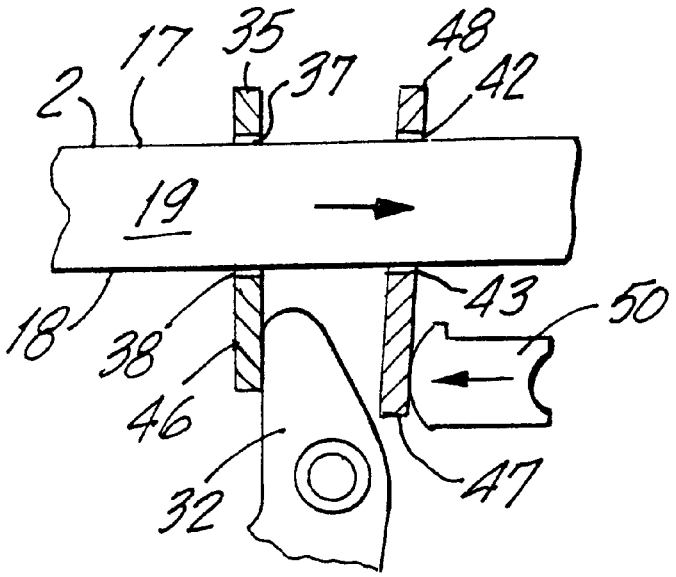
FIG. 6 is a detail showing the position of some of the parts when the jaws are to be moved away from each other.
Figure 7:
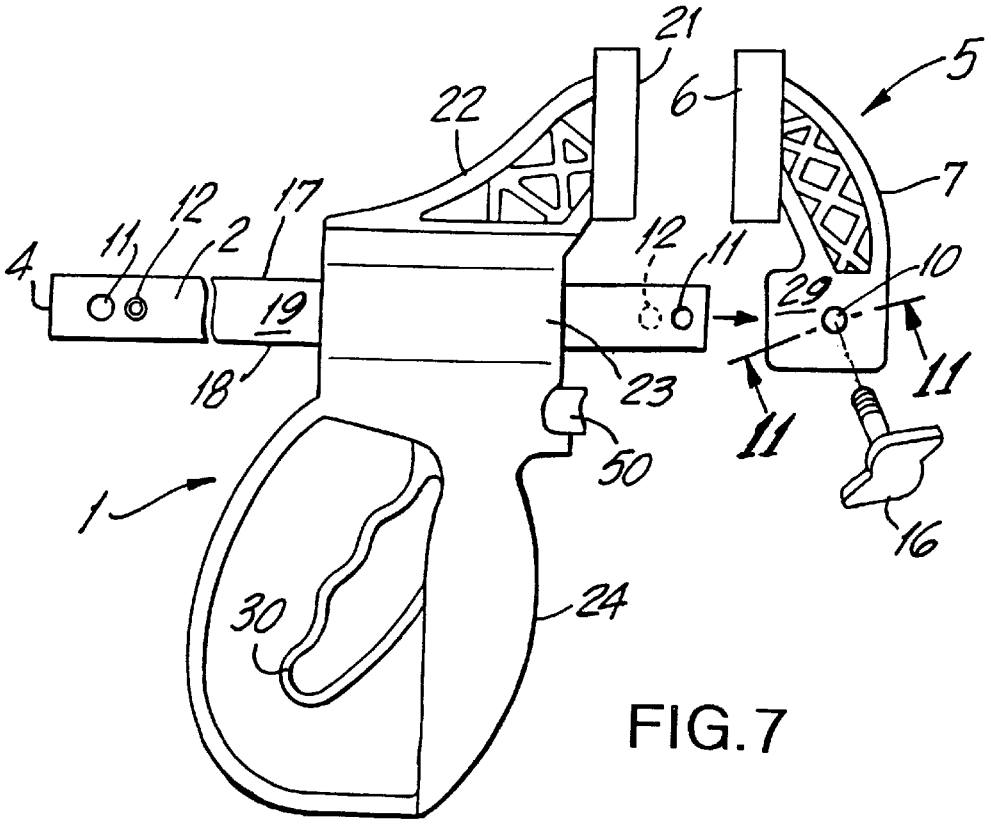
FIG. 7 is a plan view showing the manner of switching one of the jaws to a position where the jaws are used to spread an item apart.

With the position of the parts as shown in FIG. 4 squeezing the trigger 30 with one hand will pivot the active head 32 of the trigger 30 so that it will press against lower portion 46 of the advance plate 35 to angle it to cause the upper edge 37 of the opening 36 to bear against the upper edge 17 of the bar 2 and will move the bar 2 forward to move the jaw assembly 20 forward toward the first jaw assembly 5. In this position the gripping faces 6–21 will grasp an article (not shown) between them. When the trigger 30 is released the spring 39 will move the advance plate 35 back to its angled position. When it is desired to move the second jaw assembly 20 in the opposite direction to release an article from the grasp of the gripping faces 6–21, the release button 51 is pressed inwardly with the thumb of the same hand that is holding the handle assembly 24 in order to cause it to bear against the lower portion 47 of the release plate 40 and move the release plate 40 around pivot stop 49 to a position substantially perpendicular to the bar 2 as shown in FIGS. 4 and 6. This releases the hold or lock that the upper edge 42 of the opening 41 has on the upper surface 17 of the bar 2 and permits the bar 2 to be moved in the opposite direction and thereby move the second jaw assembly 20 away from the first jaw assembly 5. When the release button 50 is released the spring 44 will move release plate 40 back to its angled position thereby again locking the bar 2 against rear end movement.

It will be seen that the jaws can be moved toward each other by one part of the hand e.g. first four fingers and the other part of the hand (e.g. the thumb of the same hand) can then be used to release the jaw assemblies 5–20 for movement in the opposite direction.

If desired, the first jaw assembly 5 of the present invention can be removed from the front end 3 of the bar 2 by unscrewing and removing the wing nut 16. The first jaw assembly 5 can then be placed on the rear end 4 of the bar 2 by placing the rear end 4 into the openings 9 in the base 8 from its outer end and tightened thereon by the wing nut 16 so that the gripping faces 6–21 face away from each other. In this position, the bar clamp be used to spread articles apart.

It will thus be seen that the present invention provides an improved bar clamp which is simple to use, in which the jaws can be advanced toward each other with one hand, in which the jaws can be released to move away from each other by the same hand, which is simple and inexpensive to manufacture and in which the jaws can be easily placed in position to spread apart an item as well as to tighten on an item.

As many and varied modification of the subject matter of this invention will become apparent to those skilled in the art from the detailed description given hereinabove, it will be understood that the present invention is limited only as provided in the claims appended hereto.

What is claimed is:

1. A bar clamp comprises a first jaw assembly and a second jaw assembly, a bar, said first and second jaw assemblies being mounted on said bar, means for moving said bar relative to the second jaw assembly, a trigger operatively associated with said bar, said trigger adapted to be activated to move the bar and the first jaw assembly relative to the second jaw assembly in one direction, said trigger having a rear face and a front face, said trigger being manually movable in a direction toward said rear face releasing means on said second jaw assembly operatively associated with said bar, said releasing means being spaced from the rear face of said trigger in a direction opposite the front face of the trigger said releasing means adapted to be being manually activated in order to permit the bar and the first jaw assembly to move relative to the second jaw assembly in the opposite direction.

2. A bar clamp as said forth in claim 1 wherein an advance plate is mounted on said bar and wherein said trigger is operatively associated with said advance plate whereby activation of the trigger will cause the advance plate to move the plate in one direction.

3. A bar claim as set forth in claim 2 wherein a release plate is mounted on said bar and wherein said release means are operatively associated with said release plate whereby activation of the release means will cause the release plate to free the bar for movement in the opposite direction.

4. A bar clamp as said forth in claim 3 wherein said advance plate is normally in a position substantially perpendicular to the bar and wherein activation of the trigger will place the advance plate in an angled position to move the bar in one direction.

5. A bar clamp as said forth in claim 4 wherein said release plate is in a position normally angled to the bar and wherein activation of the release means will place the release plate in a substantially perpendicular position to permit the bar to move in the opposite direction.

6. A bar clamp as said forth in claim 5 wherein spring means are provided to move the advance plate back to its normal position upon deactivation of the trigger.

7. A bar clamp as said forth in claim 6 wherein spring means are provided to move the release plate back to its normal position upon deactivation of said release button.

8. A bar clamp as said forth in claim 7 wherein said release plate is in its normally angled position between a stop and the release means.

9. A bar clamp as said forth in claim 8 wherein the advance plate has a opening through which the bar extends, said opening having an upper edge and a lower edge and wherein said upper and lower edges bear against the upper and lower edges of the bar when the advance plate is in its angled position.

10. A bar clamp as said forth in claim 9 wherein said release plate has an opening therein through which a bar extends, said opening has upper and lower edges which bear against the upper and lower edges of the bar clamp when the release plate is in its normally angled position.

11. A bar clamp as said forth in claim 10 wherein said first jaw assembly has a gripping face and a base.

12. A bar clamp as said forth in claim 11 wherein said second jaw assembly has a gripping face and a base.

13. A bar clamp as said forth in claim 12 wherein the base of the first jaw portion has an opening into which one end of the bar is inserted.

14. A bar clamp as said forth in claim 13 wherein the base of said second jaw portion has spaced front and rear walls having openings therein through which the bar extends and moves.

15. A bar clamp as said forth in claim 14 wherein said release means is a release button which extends through the front wall in the base of the second jaw assembly.

16. A bar clamp as said forth in claim 15 wherein said trigger has a active head extending through an opening in a bottom wall of the base in the second jaw assembly.

17. A bar clamp as said forth in claim 16 wherein at least one end of the bar has an opening therein and a pin extending from the bar.

18. A bar clamp as said forth in claim 17 wherein the opening in the base of the first jaw assembly has a slot adapted to receive the said pin.

19. A bar clamp as said forth in claim 18 wherein jaw assembly holding means are adapted to be removably mounted on said bar to removably hold the first jaw assembly on said bar.

20. A bar clamp as set forth in claim 19, wherein there is provided an opening in the base of the first jaw assembly, said opening having a threaded portion, and said holding means comprises a threaded member mountable in the opening in the base and through the opening in the bar.

21. A bar clamp comprising first jaw assembly, a bar, said first and second jaw assemblies being mounted on said bar, means for moving said bar relative to the second jaw assembly, a trigger operatively associated with said bar, said trigger adapted to be activated to move the bar and the first jaw assembly relative to the second jaw assembly in one direction, release means on said second jaw assembly operatively associated with said bar, said release means adapted to be activated in order to permit the bar and the first jaw assembly to move relative to the second jaw assembly in the opposite direction, an advance plate is mounted on said bar and wherein said trigger is operatively associated with said advance plate whereby activation of the trigger will cause the advance plate to move the plate in one direction, a release plate is mounted on said bar and wherein said release means are operatively associated with said release plate whereby activation of the release means will cause the release plate to free the bar for movement in the opposite direction, advance plate is normally in a position substantially perpendicular to the bar and wherein activation of the trigger will place the advance plate in an angled position to move the bar in one direction, release plate is in a position normally angled to the bar and wherein activation of the release means will place the release plate in a substantially perpendicular position to permit the bar to move in the opposite direction, spring means are provided to move the advance plate back to its normal position upon deactivation of the trigger, spring means are provided to move the release plate back to its normal position upon deactivation of said release button, said release plate is in its normally angled position between a stop and the release means, the advance plate has a opening through which the bar extends, said opening having an upper edge and a lower edge and wherein said upper and lower edges bear against the upper and lower edges of the bar when the advance plate is in its angled position, said release plate has an opening therein through which a bar extends, said opening has upper and lower edges which bear against the upper and lower edges of the bar clamp when the release plate is in its normally angled position, said first jaw assembly has a gripping face and a base, said second jaw assembly has a gripping face and a base, the base of the first jaw portion has an opening into which one end of the bar is inserted, the base of said second jaw portion has spaced front and rear walls having openings therein through which the bar extends and moves, said release means is a release button which extends through the front wall in the base of the second jaw assembly, said trigger has a active head extending through an opening in a bottom wall of the base in the second jaw assembly, at least one end of the bar has an opening therein and a pin extending from the bar, the opening in the base of the first jaw assembly has a slot adapted to receive the said pin, said jaw assembly holding means are adapted to be removably mounted on said bar to removably hold the first jaw assembly on said bar, an opening in the base of the first jaw assembly, said opening having a threaded portion, and said holding means comprises a threaded member mountable in the opening in the base and through the opening in the bar, the other end of the bar has an opening and a pin extending therefrom to permit the other end of the bar to receive said first jaw assembly.

* * * * *